US011837790B2

(12) United States Patent
Kim et al.

(10) Patent No.: US 11,837,790 B2
(45) Date of Patent: Dec. 5, 2023

(54) CIRCULARLY POLARIZED ARRAY ANTENNA AND CIRCULARLY POLARIZED ARRAY ANTENNA MODULE

(71) Applicant: SAMSUNG ELECTRO-MECHANICS CO., LTD., Suwon-si (KR)

(72) Inventors: Sanghyun Kim, Suwon-si (KR); Dusik Kim, Suwon-si (KR); Eun-kyoung Kim, Suwon-si (KR); Byeongdeok Park, Suwon-si (KR); Yeook Jeon, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 85 days.

(21) Appl. No.: 17/318,455

(22) Filed: May 12, 2021

(65) Prior Publication Data

US 2022/0173527 A1 Jun. 2, 2022

(30) Foreign Application Priority Data

Nov. 27, 2020 (KR) ..... 10-2020-0162764

(51) Int. Cl.
*H01Q 21/06* (2006.01)
*H01Q 9/04* (2006.01)
*H01Q 21/24* (2006.01)

(52) U.S. Cl.
CPC ..... *H01Q 21/065* (2013.01); *H01Q 9/0428* (2013.01); *H01Q 21/24* (2013.01)

(58) Field of Classification Search
CPC ..... H01Q 21/065; H01Q 9/0428; H01Q 21/24
See application file for complete search history.

(56) References Cited

U.S. PATENT DOCUMENTS 5,231,406 A * 7/1993 Sreenivas ..... H01Q 21/065 343/700 MS
10,263,571 B2 4/2019 Han et al.
(Continued)

FOREIGN PATENT DOCUMENTS

CN 108899658 A * 11/2018
JP 3212084 B2 9/2001
(Continued)

OTHER PUBLICATIONS

Delgado-Castillo, Ruben F.M., et al., "Linearly and Circularly Polarized Elements on Sequentially Rotated 2x2 Arrays for 60 GHz BANs", 2017 IEEE International Symposium on Antennas and Propagation & USNC/URSI National Radio Science Meeting, San Diego, CA, USA (Jul. 9-Jul. 14, 2017) (2 pages in English).
(Continued)

*Primary Examiner* — Dieu Hien T Duong
(74) *Attorney, Agent, or Firm* — NSIP Law

(57) ABSTRACT

A circularly polarized array antenna may include: a dielectric material substrate; and at least one unit antenna including a plurality of radiators arranged sequentially in a rotational direction on the dielectric material substrate such that feeders of the plurality of radiators have a phase difference. The plurality of radiators may be arranged in a diagonal direction with respect to a first direction and a second direction crossing each other. Radiators neighboring each other in the first direction or the second direction, among the plurality of radiators, may be spaced apart by a gap of at least a width of the radiators neighboring each other in the first direction or the second direction.

16 Claims, 10 Drawing Sheets

(56) References Cited

U.S. PATENT DOCUMENTS

| | | | | |
|---|---|---|---|---|
| 2010/0007560 | A1 | 1/2010 | Ryou et al. | |
| 2016/0190697 | A1* | 6/2016 | Preradovic | H01Q 9/0428 343/700 MS |
| 2020/0403322 | A1* | 12/2020 | Ryu | H01Q 21/08 |
| 2021/0044011 | A1* | 2/2021 | Liu | H01Q 1/38 |
| 2021/0044028 | A1* | 2/2021 | Lee | H01Q 19/005 |

FOREIGN PATENT DOCUMENTS

| | | | |
|---|---|---|---|
| KR | 10-0837102 | B1 | 6/2008 |
| KR | 10-1982411 | B1 | 5/2019 |

OTHER PUBLICATIONS

Huang, John, "A Technique for an Array to Generate Circular Polarization with Linearly Polarized Elements", IEEE Transactions on Antennas and Propagation, 1986 vol. 34; Iss. 9, pp. 1113-1124. (12 pages in English).

* cited by examiner

CIRCULARLY POLARIZED ARRAY ANTENNA AND CIRCULARLY POLARIZED ARRAY ANTENNA MODULE

CROSS-REFERENCE TO RELATED APPLICATIONS

This application claims the benefit under 35 U.S.C. § 119(a) of Korean Patent Application No. 10-2020-0162764 filed in the Korean Intellectual Property Office on Nov. 27, 2020, the entire disclosure of which is incorporated herein by reference for all purposes.

BACKGROUND

1. Field

The following description relates to a circularly polarized array antenna and a circularly polarized array antenna module.

2. Description of the Related Art

As the radio communication market continues to develop, data consumption is very steeply increasing. To satisfy demands according to increasing radio communication traffic, the millimeter wave bandwidth available for wider bandwidths has become a focal point for technological development. The millimeter wave has a short wavelength according to the radio wave characteristic, may down-size antennas and devices, and may use a wide bandwidth. Therefore, the millimeter wave has the benefit of having the capacity to transmit a large amount of information.

In particular, Wireless Gigabit (WiGig) technology is being developed. WiGig is an extremely fast near field communication standard operable in the frequency band of 60 GHz, and is optimized for short-range transmission between devices of digital image services. WiGig is a method for substituting for an HDMI cable (optical cable) of a high-rate image transmitting field between devices that existing Wi-Fi failed to cover due to the limit of transmission rates in the wireless scheme. As an uncompressed large-capacity video transmission using high transmission rates becomes available, WiGig will be used for various multimedia devices in the future.

Recent antenna technology focuses on down-sizing for increasing lightness in weight, thinness, shortness, and compactness of devices, increasing efficiency of radio waves, and improving beamforming. To achieve these objectives, circularly polarized antennas that are robust against obstacle noise and multiple reflection interference receive significant developmental attention. However, the conventional circularly polarized antenna has limits with respect to feeding methods and configurations for efficient and precise beamforming. Particularly, it is difficult to implement a conventional circularly polarized array antenna including a plurality of unit antennas in down-sized devices.

The above information disclosed in this Background section is only for enhancement of understanding of the background of the disclosure, and, therefore, may contain information that does not form the prior art.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

In one general aspect, a circularly polarized array antenna includes: a dielectric material substrate; and at least one unit antenna including a plurality of radiators arranged sequentially in a rotational direction on the dielectric material substrate such that feeders of the plurality of radiators have a phase difference. The plurality of radiators are arranged in a diagonal direction with respect to a first direction and a second direction crossing each other. Radiators neighboring each other in the first direction or the second direction, among the plurality of radiators, are spaced apart by a gap of at least a width of the radiators neighboring each other in the first direction or the second direction.

The plurality of radiators may include a first radiator, a second radiator, a third radiator, and a fourth radiator arranged in a clockwise direction, and configured to be fed such that phase differences of the first radiator, the second radiator, the third radiator, and the fourth radiator are 0°, 90°, 180°, and 270°, respectively.

The plurality of radiators may include a first radiator, a second radiator, and a third radiator arranged in a triangle, and configured to be fed such that phase differences of the first radiator, the second radiator, and the third radiator are 0°, 120°, and 240°, respectively.

The plurality of radiators may include a first radiator and a second radiator configured to be fed such that phase differences of the first radiator and the second radiator are 0° and 180°, respectively.

The at least one unit antenna may include a plurality of unit antenna arranged on the dielectric material substrate in the first direction or the second direction.

The plurality of radiators of each of the plurality of unit antennas may be arranged in at least two rows. Radiators positioned in different rows with respect to each other, among the plurality of radiators of each of the plurality of unit antennas, are disposed staggered with respect to each other.

Radiators of different unit antennas, among the plurality of radiators of each of the plurality of unit antennas, neighboring each other in the first direction may be spaced apart by a gap that is equal to or greater than a maximum width of each of the radiators of the different unit antennas measured in the first direction.

Radiators of different unit antennas, among the plurality of radiators of each of the plurality of the unit antennas, neighboring each other in the second direction may be spaced apart by a gap that is equal to or greater than a maximum width of the radiators of the different unit antennas measured in the second direction.

At least parts of the radiators neighboring each other in the first direction may be positioned on different layers with respect to a thickness direction of the dielectric material substrate.

Each radiator among the plurality of radiators may include a driving patch connected to a respective feeder among the feeders, and a coupling patch spaced apart from the driving patch in a thickness direction of the dielectric material substrate.

The coupling patch of one of the radiators neighboring each other in the first direction may be positioned on a same layer as the driving patch of another one of the radiators neighboring each other.

The plurality of radiators may be respectively connected to feeding lines separated from each other.

In another general aspect, a circularly polarized array antenna includes: a dielectric material substrate; and a unit antenna including a plurality of radiators arranged sequentially in a rotational direction on the dielectric material substrate such that there is a phase difference of feeders. At least parts of radiators neighboring each other in a first direction parallel to an edge of the dielectric material substrate, among the plurality of radiators, are positioned on different layers with respect to a thickness direction of the dielectric material substrate.

Each radiator among the plurality of radiators may include a driving patch connected to a respective feeder among the feeders, and a coupling patch spaced apart from the driving patch in a thickness direction of the dielectric material substrate.

The coupling patch of one of the radiators neighboring each other in the first direction may be positioned on a same layer as the driving patch of another one of the radiators neighboring each other.

In another general aspect, a circularly polarized array antenna module includes: a substrate; at least one circularly polarized array antenna disposed on one side of the substrate; and at least one electronic element installed on another side of the substrate. The circularly polarized array antenna includes at least one unit antenna including a plurality of radiators sequentially arranged in a rotational direction such that there is a phase difference of feeders on the substrate. The plurality of radiators are arranged in a diagonal direction with respect to a first direction and a second direction crossing each other. Radiators neighboring each other in the first direction or the second direction, among the plurality of radiators, are spaced apart by a gap of at least a width of the radiators neighboring each other in the first direction or the second direction.

The radiators neighboring each other in the first direction may be spaced apart by a gap that is equal to or greater than a maximum width, in the first direction, of the radiators neighboring each other in the first direction.

The at least one unit antenna may include a plurality of the unit antennas arranged on the dielectric material substrate in the first direction or the second direction. Radiators of different unit antennas, among the plurality of radiators of each of the plurality of unit antennas, neighboring each other in the first direction may be spaced apart by a gap that is equal to or greater than a maximum width of the radiators of the different unit antennas measured in the first direction.

The at least one unit antenna may include a plurality of unit antennas arranged on the dielectric material substrate in the first direction or the second direction. Radiators of different unit antennas, among the plurality of radiators of each of the plurality of unit antennas, neighboring each other in the second direction may be spaced apart by a gap that is equal to or greater than a maximum width of the radiators of the different unit antennas measured in the second direction.

At least parts of the radiators neighboring each other in the first direction may be positioned on different layers with respect to a thickness direction of the dielectric material substrate.

The plurality of radiators may be respectively connected to feeding lines separated from each other.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative sizes, proportions, and depictions of elements in the drawings may be exaggerated for clarity, illustration, and convenience.

DETAILED DESCRIPTION

Figure 1:
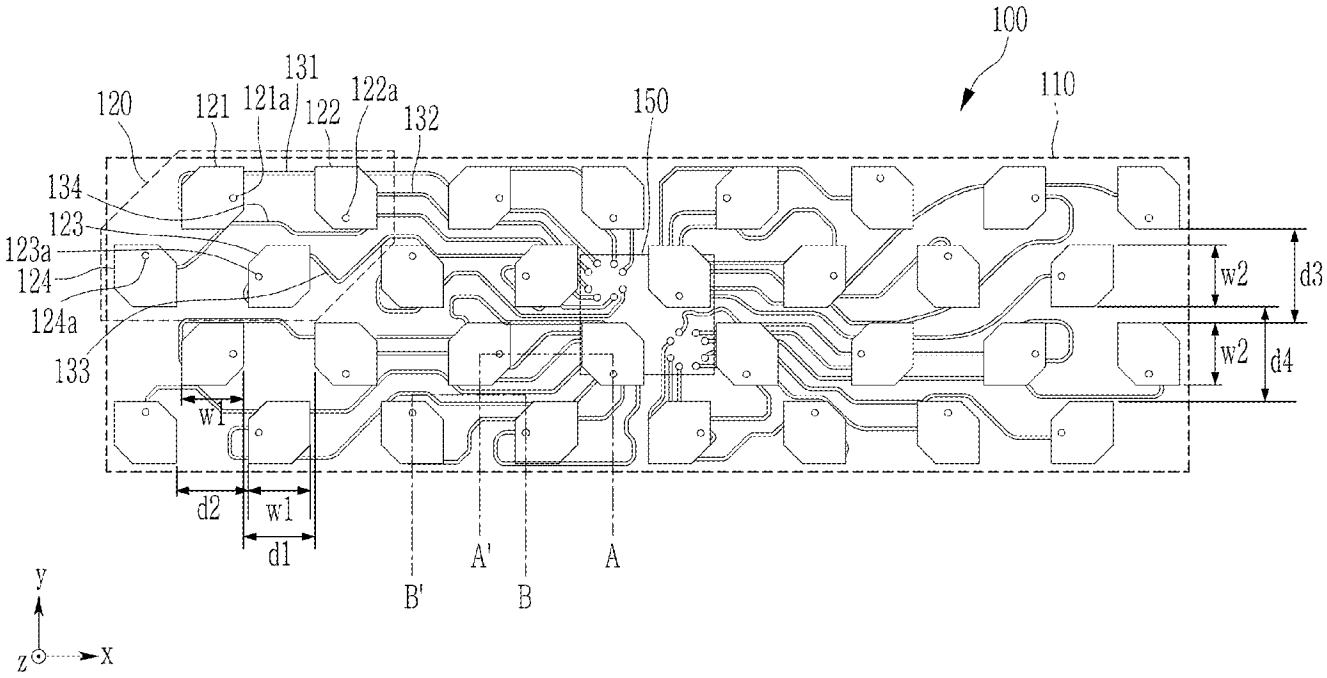
FIG. 1 is a top plan view of radiators and feeding lines of a circularly polarized array antenna, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of this disclosure. For example, the sequences of operations described herein are merely examples, and are not limited to those set forth herein, but may be changed as will be apparent after an understanding of this disclosure, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of this disclosure. Hereinafter, while embodiments of the present disclosure will be described in detail with reference to the accompanying drawings, it is noted that examples are not limited to the same.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. As used herein "portion" of an element may include the whole element or less than the whole element.

As used herein, the term "and/or" includes any one and any combination of any two or more of the associated listed items; likewise, "at least one of" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

It will be further understood that terms "includes or "have" used in this description specify the presence of stated features, numerals, steps, operations, components, parts, or a combination thereof, but do not preclude the presence or addition of one or more other features, numerals, steps, operations, components, parts, or a combination thereof. Unless explicitly described to the contrary, the word "include" and variations such as "includes" or "including" will be understood to imply the inclusion of stated elements but not the exclusion of any other elements.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of this disclosure. Further, although the examples described herein have a variety of configurations, other configurations are possible as will be apparent after an understanding of this disclosure.

Herein, it is noted that use of the term "may" with respect to an example, for example, as to what an example may include or implement, means that at least one example exists in which such a feature is included or implemented while all examples are not limited thereto.

FIG. 1 is a top plan view of radiators and feeding lines of a circularly polarized array antenna 100, according to an embodiment.

Referring to FIG. 1, the circularly polarized array antenna 100 may include, for example, a unit antenna 120 including a plurality of radiators. The plurality of radiators may include, for example, a first radiator 121, a second radiator 122, a third radiator 123, and a fourth radiator 124 arranged sequentially in a circular, or rotational, direction on the dielectric material substrate 110. The dielectric material substrate 110 may, for example, have a planar side in a rectangular shape. In this disclosure, a direction parallel to a long side of the dielectric material substrate 110 may be considered to be a first direction (the x-axis direction in the drawing), and a direction parallel to a short side of the dielectric material substrate 110 may be considered to be a second direction (the y-axis direction in the drawing). Thus, the first direction and the second direction are directions crossing each other.

The first, second, third, and fourth radiators 121, 122, 123, and 124 forming the unit antenna 120 may be arranged in a diagonal direction that is diagonal to the first direction and the second direction crossing each other. Further, the first, second, third, and fourth radiators 121, 122, 123, and 124 may be arranged in two rows, and may be shifted and disposed such that the first, second, third, and fourth radiators 121, 122, 123, and 124 positioned in different rows may be alternately arranged. That is, the first radiator 121 may neighbor a region between the third radiator 123 and the fourth radiator 124 in the second direction, and the third radiator 123 may neighbor a region between the first radiator 121 and the second radiator 122 in the second direction.

Radiators neighboring each other in the first direction, among the first, second, third, and fourth radiators 121, 122, 123, and 124 of the unit antenna 120, may be spaced apart by a gap of at least the width of each of the first, second, third, and fourth radiators of the unit antenna 120 measured in the first direction. That is, a distance d1 between the first radiator 121 and the second radiator 122 may be equal to or greater than the maximum width w1 of the first and second radiators 121 and 122 in the first direction and a distance d2 between the third radiator 123 and the fourth radiator 124 may be equal to or greater than the maximum width w1 of the third and fourth radiators 123 and 124 in the first direction. The first, second, third, and fourth radiators 121, 122, 123, and 124 may be arranged sequentially in a circular direction, or rotational direction, so as to have phase differences of respective feeders 121*a*, 122*a*, 123*a*, and 124*a* of the first, second, third, and fourth radiators 121, 122, 123, and 124. That is, the first radiator 121, the second radiator 122, the third radiator 123, and the fourth radiator 124 may be arranged in a clockwise direction, and may be fed so that their respective phase differences are 0°, 90°, 180°, and 270°. Therefore, when a phase of the feeder 121*a* of the first radiator 121 is given as 0°, phases of the respective feeders 122*a*, 123*a*, and 124*a* of the second radiator 122, the third radiator 123, and the fourth radiator 124 may be formed to have respective phase differences of 90°, 180°, and 270° with respect to the feeder 121*a* of the first radiator 121. Therefore, the unit antenna 120 may be configured to be fed in sequential rotation to the respective radiators 121, 122, 123, and 124.

The first, second, third, and fourth radiators 121, 122, 123, and 124 may be made of respective conductor patches. The respective conductor patches may have a shape in which one pair of edges facing each other are chamfered from a quadrangle. That is, the first, second, third, and fourth radiators 121, 122, 123, and 124 may have a hexagonal plan shape. The first radiator 121 and the third radiator 123 may be point symmetric with each other, and the second radiator 122 and the fourth radiator 124 may also be point symmetric with each other. However, the first, second, third, and fourth radiators 121, 122, 123, and 124 may have various shapes that perform a radiation operation in addition to the above-described shapes.

In an example, the circularly polarized array antenna 100 may include a plurality of unit antennas 120 arranged on the dielectric material substrate 110 in the first direction or the second direction. For example, as shown in FIG. 1, the circularly polarized array antenna 100 may include eight unit antennas 120 arranged in a 4×2 array.

The first, second, third, and fourth radiators 121, 122, 123, and 124 in the circularly polarized array antenna 100 may be disposed such that a gap of at least the width of each of the first, second, third, and fourth radiators is provided between radiators neighboring each other in the first direction and the second direction. Therefore, the first, second, third, and fourth radiators 121, 122, 123, and 124 respectively belonging to the neighboring unit antennas 120 that are different from each other may be spaced apart by a gap therebetween. For example, the second radiator 122 may be spaced apart from the first radiator 121 of the neighboring different unit antenna 120 by a gap in the first direction, and the third radiator 123 may be spaced apart from the fourth radiator 124 of the neighboring different unit antenna 120 by a gap in the first direction.

Further, regarding respective first, second, third, and fourth radiators 121, 122, 123, and 124 of different unit antennas 120, the radiators neighboring each other in the second direction may be spaced apart by a gap of at least the width of the first, second, third, and fourth radiators 121, 122, 123, and 124 measured in the second direction. That is, a distance d3 between the second radiator 122 (or the first radiator 121) of one unit antenna 120 and the second radiator 122 (or the first radiator 121) of the different unit antenna 120 neighboring in the second direction, and a distance d4 between the fourth radiator 124 (or the third radiator 123) of the one antenna unit 120 and the fourth radiator 124 (or the third radiator 123) of the different unit antenna 120 neighboring in the second direction, may be equal to or greater than the maximum width w2 of each of the neighboring radiators in the second direction.

An electric field generated by a radiator of a microstrip antenna is strongly generated at the position of the feeder in the perpendicular or horizontal direction. Therefore, the first, second, third, and fourth radiators 121, 122, 123, and 124 are disposed in the diagonal direction with respect to the first and second directions (horizontal and perpendicular directions) in the circularly polarized array antenna 100, so the directions of the electric field may not overlap each other and interference among them may be reduced. That is, the radiators 121, 122, 123, and 124 neighboring each other in the horizontal and perpendicular directions are spaced apart by a gap of at least the width of each of the neighboring radiators, so that end portions of the radiators may be maintained in a free space, and the required area may be reduced while reducing the interference among the radiators neighboring each other.

The radiators 121, 122, 123, and 124 included in the circularly polarized array antenna 100 may be respectively connected to feeding lines 131, 132, 133, and 134 in respective feeders 121*a*, 122*a*, 123*a*, and 124*a*. The feeding lines 131, 132, 133, and 134 may be connected to an integrated circuit (IC) chip 150 and may receive a signal for driving the circularly polarized array antenna 100.

Figure 2:
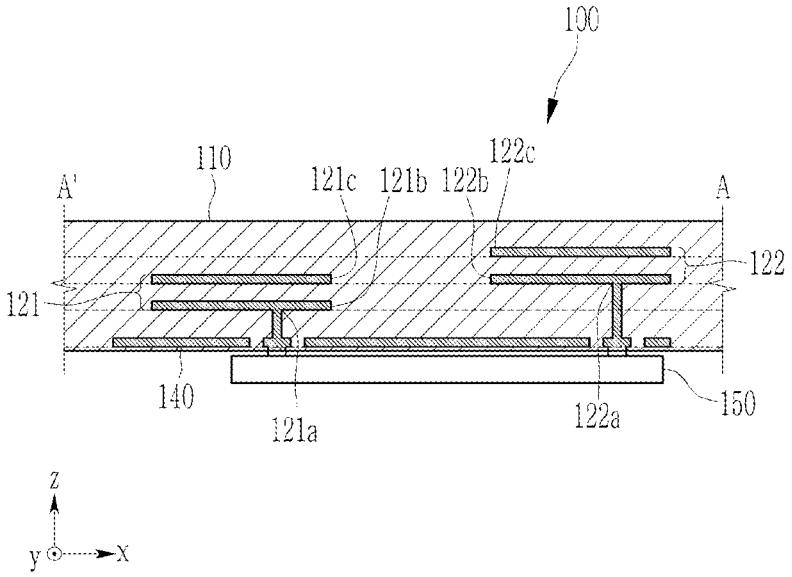
FIG. 2 is a cross-sectional view with respect to a line A-A' of FIG. 1.
Figure 3:
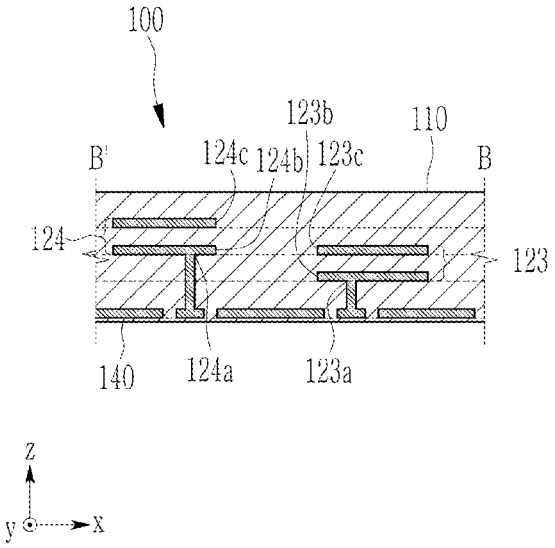
FIG. 3 is a cross-sectional view with respect to a line B-B' of FIG. 1.

FIG. 2 shows a cross-sectional view with respect to a line A-A' of FIG. 1, and FIG. 3 shows a cross-sectional view with respect to a line B-B' of FIG. 1.

Referring to FIG. 2 and FIG. 3, in the circularly polarized array antenna 100, at least part of radiators neighboring each other in the first direction, among the first, second, third, and fourth radiators 121, 122, 123, and 124, may be positioned on different layers of the dielectric material substrate 110, with respect to the thickness direction (the z-axis direction in the drawing) of the dielectric material substrate 110. That is, at least part of the first radiator 121 and a part of the second radiator 122 neighboring the first radiator 121 in the first direction may be positioned on different layers. For example, a part layer of the first radiator 121 may be positioned lower than a part layer of the second radiator 122. Further, at least part of the third radiator 123 and a part of the fourth radiator 124 neighboring the third radiator 123 in the first direction may be positioned on different layers. For example, a part layer of the third radiator 123 may be positioned lower than a part layer of the fourth radiator 124.

The first, second, third, and fourth radiators 121, 122, 123, and 124 may respectively include driving patches 121*b*, 122*b*, 123*b*, and 124*b* directly connected to the feeders 121*a*, 122*a*, 123*a*, and 124*a*, respectively, and coupling patches 121*c*, 122*c*, 123*c*, and 124*c* spaced apart from the driving patches 121*b*, 122*b*, 123*b*, and 124*b*, respectively, in the thickness direction of the dielectric material substrate 110. The driving patches 121*b*, 122*b*, 123*b*, and 124*b* and the respective coupling patches 121*c*, 122*c*, 123*c*, and 124*c* are not connected to each other by a conductor, but may be electrically coupled to each other with a dielectric layer positioned therebetween.

Therefore, one of the coupling patches 121*c*, 122*c*, 123*c*, and 124*c* from among the radiators 121, 122, 123, and 124 neighboring each other in the first direction may be positioned on a same layer as the other one of the driving patches 121*b*, 122*b*, 123*b*, and 124*b*.

For example, the coupling patch 121*c* of the first radiator 121 may be positioned on a same layer as the driving patch 122*b* of the second radiator 122. In this instance, the driving patch 121*b* of the first radiator 121 may be positioned lower than the driving patch 122*b* of the second radiator 122, and the coupling patch 122*c* of the second radiator 122 may be positioned higher than the coupling patch 121*c* of the first radiator 121. Further, the coupling patch 123*c* of the third radiator 123 may be positioned on a same layer as the driving patch 124*b* of the fourth radiator 124. In this instance, the driving patch 123*b* of the third radiator 123 may be positioned lower than the driving patch 124*b* of the fourth radiator 124, and the coupling patch 124*c* of the fourth radiator 124 may be positioned higher than the coupling patch 123*c* of the third radiator 123.

The radiators 121, 122, 123, and 124 neighboring each other in the diagonal direction obliquely extending with respect to the first direction and the second direction may be positioned on different layers with respect to the thickness direction of the dielectric material substrate 110. That is, the first radiator 121 and the fourth radiator 124 neighboring each other in the diagonal direction may be positioned on different layers, and the second radiator 122 and the third radiator 123 neighboring each other in the diagonal direction may be positioned on different layers. For example, the first radiator 121 may be positioned lower than the fourth radiator 124, and the second radiator 122 may be positioned lower than the third radiator 123.

Therefore, one of the coupling patches 121*c*, 122*c*, 123*c*, and 124*c* from among the radiators 121, 122, 123, and 124 neighboring each other in the diagonal direction may be positioned on the same layer as the other one of the driving patches 121*b*, 122*b*, 123*b*, and 124*b*.

For example, the coupling patch 121*c* of the first radiator 121 may be positioned on the same layer as the driving patch 124*b* of the fourth radiator 124. In this instance, the driving patch 121*b* of the first radiator 121 may be positioned lower than the driving patch 124*b* of the fourth radiator 124, and the coupling patch 124*c* of the fourth radiator 124 may be positioned higher than the coupling patch 121*c* of the first radiator 121. Further, the coupling patch 123*c* of the third radiator 123 may be positioned on the same layer as the driving patch 122*b* of the second radiator 122. In this instance, the driving patch 123*b* of the third radiator 123 may be positioned lower than the driving patch 122*b* of the second radiator 122, and the coupling patch 122*c* of the second radiator 122 may be positioned higher than the coupling patch 123*c* of the third radiator 123.

The driving patches 121*b*, 122*b*, 123*b*, and 124*b* of the radiators 121, 122, 123, and 124 are connected to the feeders 121*a*, 122*a*, 123*a*, and 124*a*, respectively, an initial electric field is formed by a feeding, and rigidity of the circularly polarized array antenna 100 may be maintained. Therefore, as described above, by disposing the driving patches 121*b*, 122*b*, 123*b*, and 124*b* of the radiators 121, 122, 123, and 124 neighboring each other in the first direction or the diagonal direction on different layers, mutual interference may be reduced.

Figure 4:
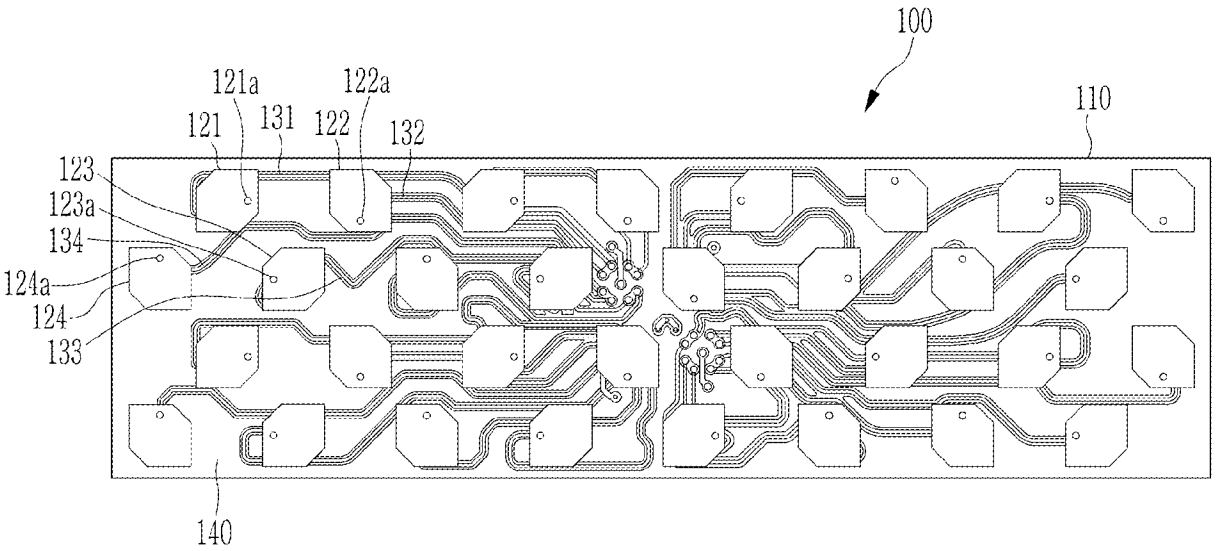
FIG. 4 is a top plan view of the circularly polarized array antenna, according to an embodiment, and illustrating the radiators, the feeding lines, and a ground portion.

FIG. 4 is a top plan view of the circularly polarized array antenna 100, according to an embodiment, and illustrating the radiators 121, 122, 123, and 124, the feeding lines 131, 132, 133, and 134, and a ground portion 140.

Referring to FIG. 4, the circularly polarized array antenna 100 may include the ground portion 140 and the feeding lines 131, 132, 133, and 134 on the lower layer of the dielectric material substrate 110. The feeding lines 131, 132, 133, and 134 are patterned to be insulated from the ground portion 140 and may be disposed on the same plane as the ground portion 140.

The radiators 121, 122, 123, and 124 may be respectively connected to the feeding lines 131, 132, 133, and 134 in the feeders 121*a*, 122*a*, 123*a*, and 124*a*, respectively. That is, feed vias may be positioned on the dielectric material substrate 110 to respectively correspond to the feeders 121*a*, 122*a*, 123*a*, and 124*a*, and the feed vias may be respectively connected to the feeding lines 131, 132, 133, and 134 and may configure an electrical connection. Also, the feeding lines 131, 132, 133, and 134 may be patterned to extend at the lower layer of the dielectric material substrate 110 and may be connected to a conductive pad connected to the integrated circuit (IC) chip 150.

The circularly polarized array antenna 100 is disposed on one side of a substrate, and an electronic element including the integrated circuit (IC) chip 150 may be disposed on the other side of the substrate to thus configure a circularly polarized array antenna module. The ground portion 140 and circuit wires may be arranged on one side of the substrate on which the electronic element is disposed. The substrate may be a dielectric material substrate 110.

Figure 5:
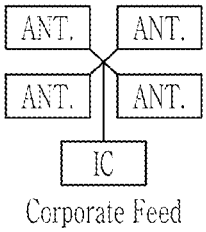
FIG. 5 is a schematic view of a corporate feed structure in a sequential arrangement, according to an embodiment.
Figure 6:
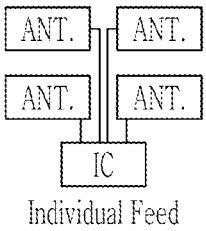
FIG. 6 is a schematic view of an individual feed structure in a sequential arrangement, according to an embodiment.

FIG. 5 is a schematic view of a corporate feed structure in a sequential arrangement, according to an embodiment. FIG. 6 is a schematic view of an individual feed structure in a sequential arrangement.

In contrast to linear polarization, an axial ratio is an important factor for a circularly polarized antenna, so the sequential feed method is used to improve the axial ratio when unit antennas are combined. Together with this, a corporate feed is used to for a sub-array.

Referring to FIG. 5 and FIG. 6, the corporate feed structure is a structure in which the feeding lines connected to individual antennas (or radiators) merge at a predetermined point to into a single feeding line connected to the IC chip from the predetermined point. In contrast, the individual feed structure is a structure in which the feeding lines connected to the individual antennas (or radiators) individually extend to be connected to the IC chip.

When the corporate feed is used in the sequential arrangement, amplitude applied to the unit antenna is the same, and a phase may take a phase difference according to the sequential arrangement. The array antenna may use a method for applying weights to unit antennas and changing amplitude so as to reduce a minor lobe, which may not be used to the corporate feed method. Further, when a corrected phase is needed for precise beamforming, the feeds merged into the single feed have a limitation that they may not be individually controlled.

The circularly polarized array antenna 100 may have an individual feed structure in which the first, second, third, and fourth radiators 121, 122, 123, and 124 forming the unit antenna 120 are respectively connected to the feeding lines 131, 132, 133, and 134 that are separated from each other. The first, second, third, and fourth radiators 121, 122, 123, and 124 configuring each of the unit antennas 120 may be connected to the same IC chip 150 through the feeding lines 131, 132, 133, and 134 that are separated from each other. Therefore, the sub-array may be applied to the IC chip 150.

By applying the individual feed structure as described above, the circularly polarized array antenna 100 may individually control the amplitudes and the phases of the radiators 121, 122, 123, and 124, thereby performing precise and efficient beamforming.

Figure 7:
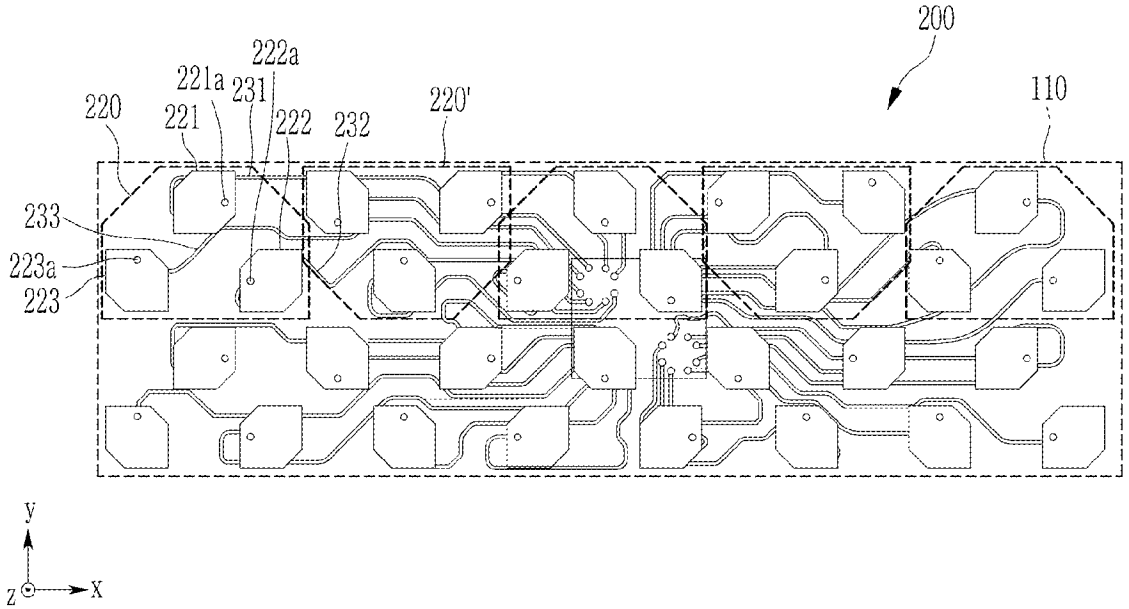
FIG. 7 is a top plan view of radiators and feeding lines of a circularly polarized array antenna, according to another embodiment.

FIG. 7 is a top plan view of radiators and feeding lines of a circularly polarized array antenna 200, according to another embodiment.

Referring to FIG. 7, the circularly polarized array antenna 200 may include, for example, a unit antenna 220/220' including a plurality of radiators. The plurality of radiators may include a first radiator 221, a second radiator 222, and a third radiator 223 sequentially arranged in circular direction on the dielectric material substrate 110. The dielectric material substrate 110 may, for example, be made to have a rectangular plan shape. A direction parallel to the long side of the dielectric material substrate 110 may be considered to be the first direction (the x-axis direction in the drawing), and a direction parallel to the short side of the dielectric material substrate 110 may be considered to be the second direction (the y-axis direction in the drawing).

A plurality of unit antennas 220/220' may be arranged on the dielectric material substrate 110 in the first direction or the second direction. For example, as shown in FIG. 7, the circularly polarized array antenna 200 may include ten unit antennas 220/220' arranged in a 5×2 array.

The first, second, and third radiators 221, 222, and 223 forming the unit antenna 220/220' may be arranged in a diagonal direction that is diagonal with respect to the first direction and the second direction crossing each other. Further, the first, second, and third radiators 221, 222, and 223 may be arranged in two rows, and may be shifted and disposed such that the first, second, and third radiators 221, 222, and 223 positioned in different rows may be alternately arranged.

Radiators neighboring each other in the first direction, among the first, second, and third radiators 221, 222, and 223 of the unit antenna 220/220', may be spaced apart by a gap of at least the width of the each of the first, second, and third radiators 221, 222, and 223 measured in the first direction. Radiators neighboring each other in the second direction, among the first, second, and third radiators 221, 222, and 223 of the unit antenna 220/220' may be spaced apart by a gap of at least the width of each of the first, second, and third radiators 221, 222, and 223 of the unit antenna 220/220' measured in the second direction.

The first, second, and third radiators 221, 222, and 223 of the unit antenna 220/220' may be sequentially arranged in a circular direction, or rotational direction, such that there may be a phase difference among respective feeders 221*a*, 222*a*, and 223*a* of the first, second, and third radiators 221, 222, and 223. That is, the first radiator 221, the second radiator 222, and the third radiator 223 may be arranged in a triangle, and may be fed so that their respective phase differences are 0°, 120°, and 240°. Therefore, when the phase of the feeder 221*a* of the first radiator 221 is set to be 0°, the phases of the respective feeders 222*a* and 223*a* of the second radiator 222 and the third radiator 223 may be provided to have differences of 120° and 240° with respect to the feeder 221*a* of the first radiator 221. Therefore, the unit antenna 220/220' may be configured to be fed in sequential rotation to the respective radiators 221, 222, and 223.

Figure 8:
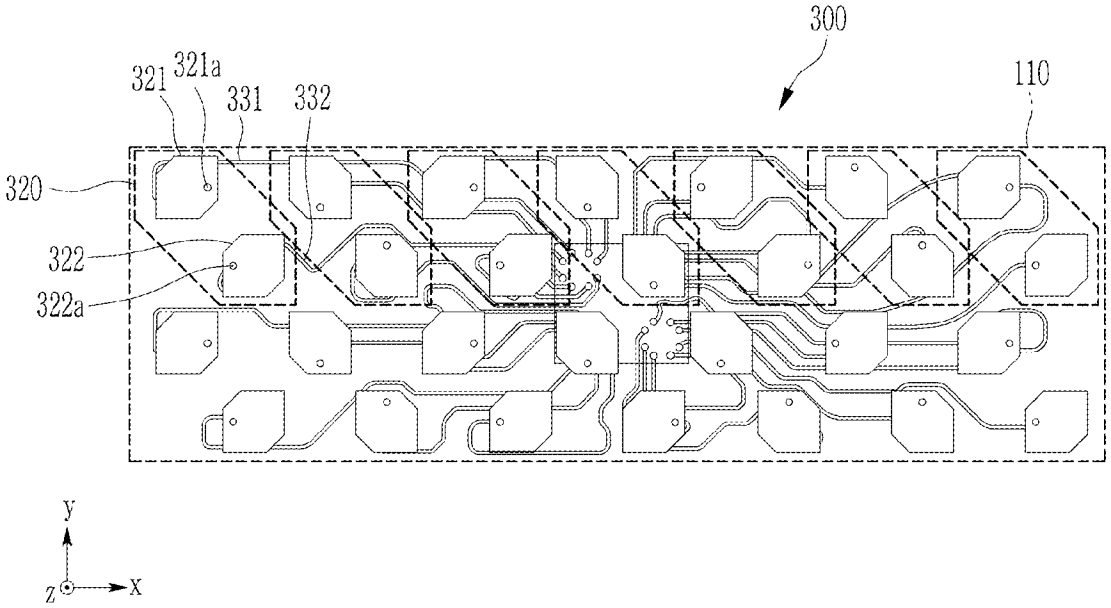
FIG. 8 is a top plan view of radiators and feeding lines of a circularly polarized array antenna, according to another embodiment.

FIG. 8 is a top plan view of radiators and feeding lines of a circularly polarized array antenna 300, according to another embodiment.

Referring to FIG. 8, the circularly polarized array antenna 300 may include, for example, a unit antenna 320 including a plurality of radiators. The plurality of radiators may include a first radiator 321 and a second radiator 322 sequentially arranged in a circular direction, or rotational direction, on the dielectric material substrate 110. The dielectric material substrate 110 may, for example, have a rectangular plan shape. The direction in parallel to the long side of the dielectric material substrate 110 may be considered to be the first direction (the x-axis direction in the drawing), and the direction in parallel to the short side of the dielectric material substrate 110 may be considered to be the second direction (the y-axis direction in the drawing).

A plurality of unit antennas 320 may be arranged on the dielectric material substrate 110 in the first direction or the second direction. For example, as shown in FIG. 8, the circularly polarized array antenna 300 may include fourteen unit antennas 320 arranged in a 7×2 array.

Radiators 321 and 322 forming the unit antenna 320 may be arranged in the diagonal direction that is diagonal with respect to the first direction and the second direction crossing each other. Further, the radiators 321 and 322 may be arranged in two rows, and may be shifted and disposed such that the radiators 321 and 322 positioned in different rows may be alternately arranged.

Radiators neighboring each other in the first direction, among the radiators 321 and 322 in the unit antenna 320, may be spaced apart by a gap of at least the width of each of the first and second radiators 321 and 322 of the unit antenna 320 measured in the first direction. Radiators, among the radiators 321 and 322 of different unit antennas 320, neighboring each other in the second direction may be spaced and disposed with a gap of at least the width of each of the radiators 321 and 322 measured in the second direction.

The radiators 321 and 322 of the unit antenna 320 may be sequentially arranged in a circular direction, or rotational direction, such that there may be a phase difference of respective feeders 321*a* and 322*a* of the radiators 321 and 322. That is, the first radiator 321 and the second radiator 322 may be arranged in the clockwise direction, and may be fed so that their respective phase differences may be 0° and 180°. Thus, the unit antenna 320 may be configured to be fed in sequential rotation to the respective radiators 321 and 322.

Figure 9:
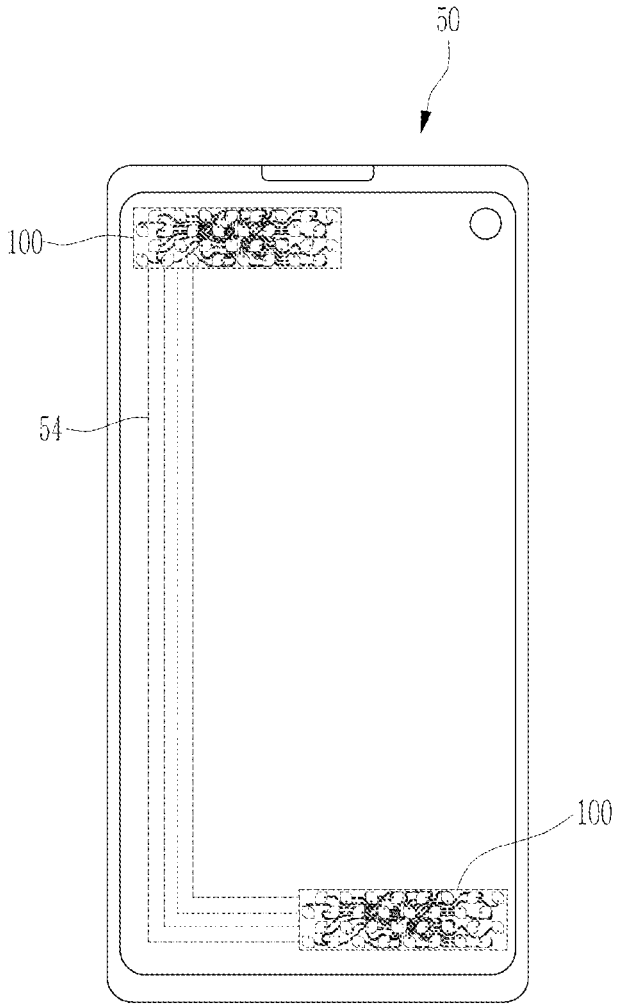
FIG. 9 shows a top plan view of an electronic device in which a circularly polarized array antenna is installed, according to an embodiment.
Figure 10:
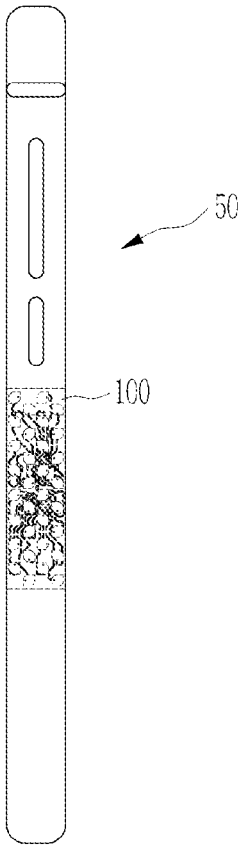
FIG. 10 shows a lateral side view of the electronic device in which a circularly polarized array antenna is installed, according to an embodiment.

FIG. 9 is a top plan view of an electronic device 50 including the circularly polarized array antenna 100, according to an embodiment. FIG. 10 is a lateral side view of the electronic device 50 in which the circularly polarized array antenna 100, according to an embodiment, is installed.

The electronic device 50 may be configured by disposing one or more circularly polarized array antennas 100, for example, on the installed set substrate. The electronic device 50 may include polygonal sides, and a circularly polarized array antenna(s) 100 may be disposed near at least some of a plurality of sides of the electronic device 50. An example for disposing the circularly polarized array antenna 100 according to the embodiment described with reference to FIG. 1 will now be described, as an example. Although the circularly polarized array antenna 100 is shown and described in the embodiment of FIG. 9, it is to be understood that the circular polarized array antenna 200 of FIG. 7 or the circular polarized array antenna 300 of FIG. 8 may be substituted for the circularly polarized array antenna 100

Referring to FIG. 9, two circularly polarized array antennas 100 may, for example, be respectively disposed near a top left corner and near a bottom right corner of the electronic device 50, and the circularly polarized array antennas 100 may, for example, be electrically connected to each other through a flexible printed circuit (FPC) board 54.

Referring to FIG. 10, the circularly polarized array antenna 100 (alternatively, the circularly polarized array antenna 200 or the circularly polarized array antenna 300) may be installed on an inner lateral side of the electronic device 50. The circularly polarized array antenna 100 has a narrow width and extends in one direction, so it may be appropriately installed on the side of the thin electronic device 50.

The electronic device 50 may be a smart phone, a personal digital assistant, a digital video camera, a digital still camera, a network system, a computer, a monitor, a tablet, a laptop, a netbook, a television, a video game, a smart watch, or an automotive part, for example, but is not limited thereto.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

DESCRIPTION OF SYMBOLS

100: circularly polarized array antenna
110: dielectric material substrate
120: unit antenna
121: first radiator
122: second radiator
123: third radiator
124: fourth radiator
121*a*, 122*a*, 123*a*, 124*a*: feeder
121*b*, 122*b*, 123*b*, 124*b*: driving patch
121*c*, 122*c*, 123*c*, 124*c*: coupling patch
131, 132, 133, 134: feeding line
140: ground portion
150: IC chip

What is claimed is:

1. A circularly polarized array antenna, comprising:
a dielectric material substrate; and at least one unit antenna including a plurality of radiators arranged sequentially in a rotational direction on the dielectric material substrate such that feeders of the plurality of radiators have a phase difference, wherein the plurality of radiators are arranged in a diagonal direction with respect to a first direction and a second direction crossing each other, wherein radiators neighboring each other in the first direction or the second direction, among the plurality of radiators, are spaced apart by a gap of at least a width of the radiators neighboring each other in the first direction or the second direction, wherein each radiator among the plurality of radiators includes a driving patch connected to a respective feeder among the feeders, and a coupling patch spaced apart from the driving patch in a thickness direction of the dielectric material substrate, and wherein the coupling patch of one of the radiators neighboring each other in the first direction is positioned on a same layer as the driving patch of another one of the radiators neighboring each other.

2. The circularly polarized array antenna of claim 1, wherein the plurality of radiators include a first radiator, a second radiator, a third radiator, and a fourth radiator arranged in a clockwise direction, and configured to be fed such that phase differences of the first radiator, the second radiator, the third radiator, and the fourth radiator are 0°, 90°, 180°, and 270°, respectively.

3. The circularly polarized array antenna of claim 1, wherein the plurality of radiators include a first radiator, a second radiator, and a third radiator arranged in a triangle, and configured to be fed such that phase differences of the first radiator, the second radiator, and the third radiator are 0°, 120°, and 240°, respectively.

4. The circularly polarized array antenna of claim 1, wherein the plurality of radiators include a first radiator and a second radiator configured to be fed such that phase differences of the first radiator and the second radiator are 0° and 180°, respectively.

5. The circularly polarized array antenna of claim 1, wherein the at least one unit antenna comprises a plurality of unit antenna arranged on the dielectric material substrate in the first direction or the second direction.

6. The circularly polarized array antenna of claim 5, wherein the plurality of radiators of each of the plurality of unit antennas are arranged in at least two rows, and wherein radiators positioned in different rows with respect to each other, among the plurality of radiators of each of the plurality of unit antennas, are disposed staggered with respect to each other.

7. The circularly polarized array antenna of claim 6, wherein radiators of different unit antennas, among the plurality of radiators of each of the plurality of unit antennas, neighboring each other in the first direction are spaced apart by a gap that is equal to or greater than a maximum width of each of the radiators of the different unit antennas measured in the first direction.

8. The circularly polarized array antenna of claim 6, wherein radiators of different unit antennas, among the plurality of radiators of each of the plurality of the unit antennas, neighboring each other in the second direction are spaced apart by a gap that is equal to or greater than a maximum width of the radiators of the different unit antennas measured in the second direction.

9. The circularly polarized array antenna of claim 1, wherein each of the plurality of radiators is connected to an IC chip via a feeding line not merged with another feeding line.

10. A circularly polarized array antenna, comprising:

a dielectric material substrate; and a unit antenna including a plurality of radiators arranged sequentially in a rotational direction on the dielectric material substrate such that there is a phase difference of feeders, wherein each radiator among the plurality of radiators includes a driving patch connected to a respective feeder among the feeders, and a coupling patch spaced apart from the driving patch in a thickness direction of the dielectric material substrate, and wherein the coupling patch of one of the radiators neighboring each other in the first direction is positioned on a same layer as the driving patch of another one of the radiators neighboring each other.

11. The circularly polarized array antenna of claim 10, wherein each of the plurality of radiators is connected to an IC chip via a feeding line not merged with another feeding line.

12. A circularly polarized array antenna module, comprising:

a substrate;

at least one circularly polarized array antenna disposed on one side of the substrate; and at least one electronic element installed on another side of the substrate, wherein the circularly polarized array antenna includes at least one unit antenna including a plurality of radiators sequentially arranged in a rotational direction such that there is a phase difference of feeders on the substrate, wherein the plurality of radiators are arranged in a diagonal direction with respect to a first direction and a second direction crossing each other, wherein radiators neighboring each other in the first direction or the second direction, among the plurality of radiators, are spaced apart by a gap of at least a width of the radiators neighboring each other in the first direction or the second direction, wherein each radiator among the plurality of radiators includes a driving patch connected to a respective feeder among the feeders, and a coupling patch spaced apart from the driving patch in a thickness direction of the dielectric material substrate, and wherein the coupling patch of one of the radiators neighboring each other in the first direction is positioned on a same layer as the driving patch of another one of the radiators neighboring each other.

13. The circularly polarized array antenna module of claim 12, wherein the radiators neighboring each other in the first direction are spaced apart by a gap that is equal to or greater than a maximum width, in the first direction, of the radiators neighboring each other in the first direction.

14. The circularly polarized array antenna module of claim 12, wherein the at least one unit antenna comprises a plurality of the unit antennas arranged on the dielectric material substrate in the first direction or the second direction, and wherein radiators of different unit antennas, among the plurality of radiators of each of the plurality of unit antennas, neighboring each other in the first direction are spaced apart by a gap that is equal to or greater than a maximum width of the radiators of the different unit antennas measured in the first direction.

15. The circularly polarized array antenna module of claim 12, wherein the at least one unit antenna comprises a plurality of unit antennas arranged on the dielectric material substrate in the first direction or the second direction, and wherein radiators of different unit antennas, among the plurality of radiators of each of the plurality of unit antennas, neighboring each other in the second direction are spaced apart by a gap that is equal to or greater than a maximum width of the radiators of the different unit antennas measured in the second direction.

16. The circularly polarized array antenna module of claim 12, wherein each of the plurality of radiators is connected to an IC chip via a feeding line not merged with another feeding line.

* * * * *